US008080756B2

(12) United States Patent
Zhao et al.

(10) Patent No.: US 8,080,756 B2
(45) Date of Patent: Dec. 20, 2011

(54) MAGNETIC SNAP ACTION SWITCH

(75) Inventors: Er-Zheng Zhao, Shenzhen (CN); Hong-Wei Zhu, Shenzhen (CN); Hai-Yang Yu, Shenzhen (CN)

(73) Assignees: Hong Fu Jin Precision Industry (ShenZhen) Co., Ltd., Shenzhen, Guangdong Province (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 369 days.

(21) Appl. No.: 12/546,639

(22) Filed: Aug. 24, 2009

(65) Prior Publication Data

US 2010/0072051 A1 Mar. 25, 2010

(30) Foreign Application Priority Data

Sep. 22, 2008 (CN) ..... 2008 1 0304597

(51) Int. Cl.
*H01H 5/00* (2006.01)

(52) U.S. Cl. ..... 200/402

(58) Field of Classification Search ..... 200/402, 200/404; 335/106, 114, 185
See application file for complete search history.

(56) References Cited

U.S. PATENT DOCUMENTS

| | | | | |
|---|---|---|---|---|
| 4,162,468 | A * | 7/1979 | Thornley | 335/106 |
| 4,868,530 | A * | 9/1989 | Ahs | 335/207 |
| 6,864,679 | B2 * | 3/2005 | Yokoji et al. | 324/207.11 |
| 7,741,938 | B2 * | 6/2010 | Kramlich | 335/77 |

* cited by examiner

*Primary Examiner* — Vanessa Girardi
(74) *Attorney, Agent, or Firm* — Altis Law Group, Inc.

(57) ABSTRACT

A snapping switch includes a base, a ring, a knob, first to third snapping members, and two contact pads. The ring is mounted on the base. The knob is rotatably engaged with the base and the ring. The first snapping member mounted on one of the ring and the knob. The second and third snapping members are separately mounted on the other one of the ring and the knob and sandwiching the first snapping member there-between. The contact pads are respectively mounted on the ring and the knob. When the knob is in a first position, the first snapping member attracts one of the second and third snapping members to separate the contact pads; and when the knob is rotated to a second position, the first snapping member can attract the other one of the second and third snapping members to make an electrical connection between the contact pads.

18 Claims, 5 Drawing Sheets

MAGNETIC SNAP ACTION SWITCH

BACKGROUND

1. Technical Field

The disclosure relates to switches, and more particularly, to a switch which can stably engage in two positions such as an ON position or an OFF position.

2. Description of Related Art

Rotary switches are commonly used to selectably make or cut an electrical connection of an electric circuit. A rotary switch generally includes a rotary member rotably engaged with a stator. The stator includes a couple of positioning members, corresponding to "on" and "off" positions of the rotary member. Each positioning member has a concavity defined therein. The rotary member includes a locating bump protruding therefrom. When the rotary member is rotated, the locating bump is received in a selected one of the concavities, thereby precisely positioning the rotary member at the desired positioning member. However, the locating bump of the rotary member is liable to become worn or damaged after repeated use.

Therefore, what is needed is to provide a snapping switch in which the above-mentioned problems are eliminated or at least alleviated.

DETAILED DESCRIPTION

Figure 1:
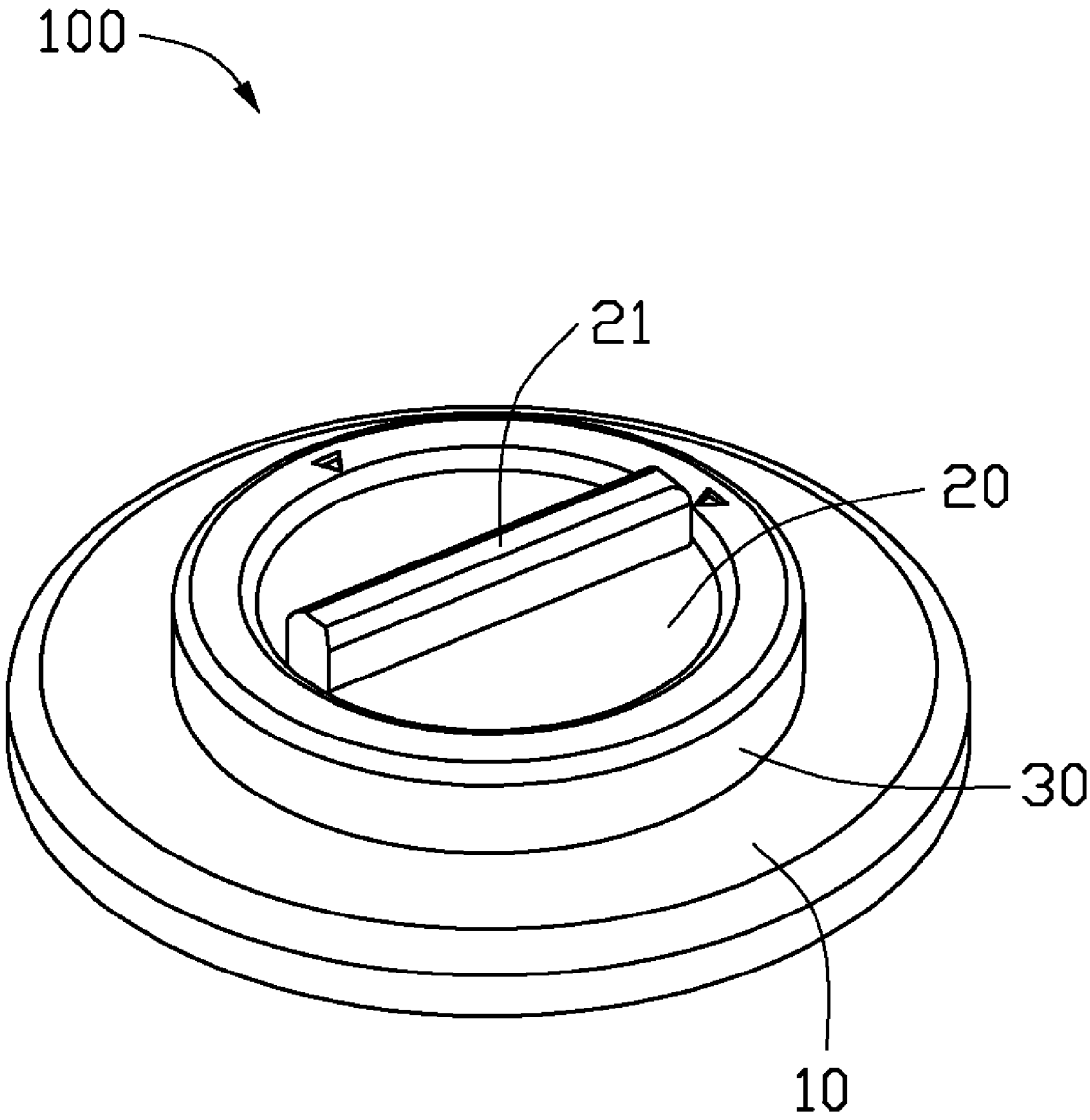
FIG. 1 is an isometric view of a snapping switch according to an exemplary embodiment.
Figure 2:
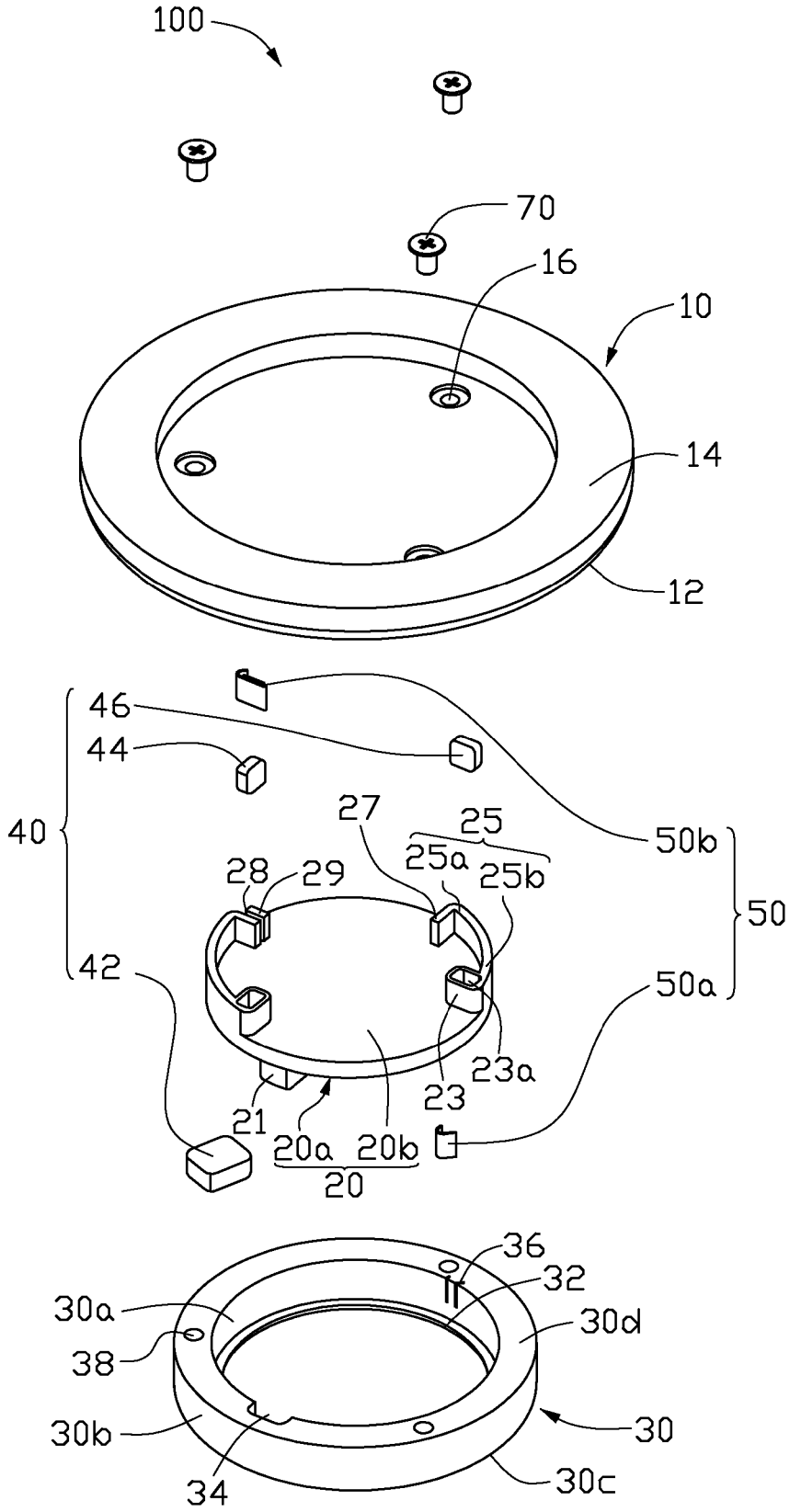
FIG. 2 is an exploded, isometric view of the snapping switch of FIG. 1, but showing the parts inverted.

Referring to FIGS. 1 and 2, a snapping switch 100 according to an exemplary embodiment of the present invention is shown. The snapping switch 100 includes a base 10, a knob 20, a ring 30, three snapping members 40, two contact pads 50, and a number of fasteners 70 such as bolts. The knob 20 is first rotatably received in the ring 30, and then the assembly of the knob 20 and the ring 30 is mounted on the base 10.

Figure 3:
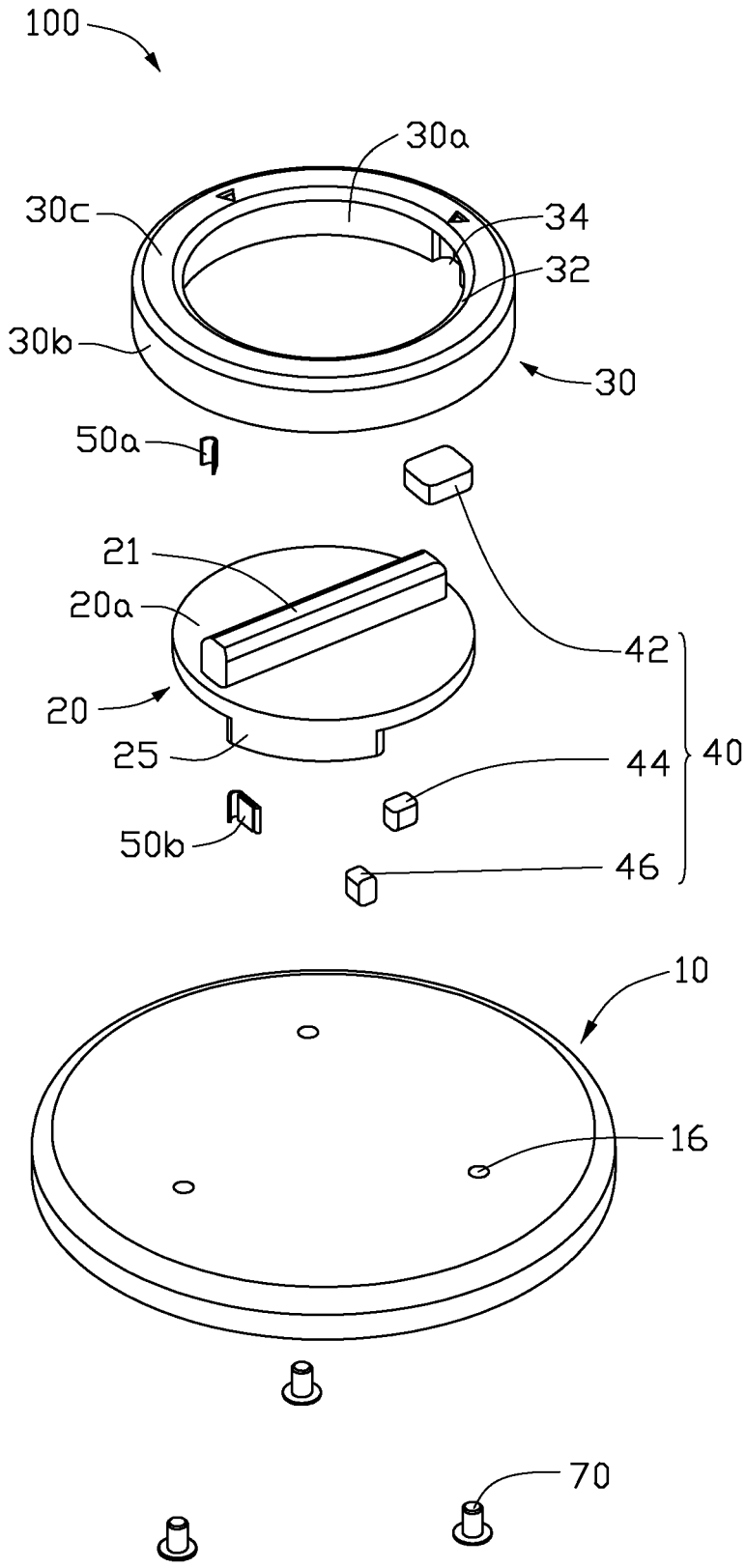
FIG. 3 is an exploded, isometric inverted view of the snapping switch of FIG. 1.

Referring also to FIG. 3, the base 10 is circular and generally disk-shaped. The base 10 includes an upper surface 12 and a lower surface 14 at opposite sides thereof. A number of through holes 16 are defined in the base 10, each through hole 16 spanning from the upper surface 12 to the lower surface 14. The through holes 16 are for engagingly receiving the bolts 70, whereby the ring 30 is fastened on the base 10.

The knob 20 is a circular and generally disk-shaped. The knob 20 includes a top surface 20*a* and a bottom surface 20*b* at opposite sides thereof, a handle 21, a pair of holding members 23, a pair of support walls 25, a pair of inner walls 27, and a positioning plate 29. The handle 21 extends upward from a middle portion of the top surface 20*a*. The support walls 25 perpendicularly extend downward from a periphery of the bottom surface 20*b*. In the illustrated embodiment, the support walls 25 have slightly different sizes. Nevertheless, the support walls 25 are positioned generally symmetrically opposite each other across the bottom surface 20*b*. The pair of inner walls 27 are integrally connected to first ends 25*a* of the support walls 25, respectively. The pair of holding members 23 are integrally connected to second ends 25*b* of the support walls 25, respectively. Each holding member 23 and each inner wall 27 radially extends toward the center of the bottom surface 20*b* of the knob 20. Each holding member 23 defines a compartment 23*a* for housing a corresponding one of the snapping members 40. The positioning plate 29 extends downward from the bottom surface 20*b* adjacent to one of the inner walls 27, and thereby a gap 28 is defined between the positioning plate 29 and the inner wall 27.

The ring 30 includes an inner peripheral surface 30*a* and an outer peripheral surface 30*b*, a top surface 30*c*, a bottom surface 30*d*, an annular flange 32, a cutout 34, and a pair of parallel slots 36. The top surface 30*c* interconnects the inner and outer peripheral surfaces 30*a*, 30*b*. The bottom surface 30*d* is parallel to the top surface 30*c*, and also interconnects the inner peripheral surface 30*a* and the outer peripheral surface 30*b*. A diameter of an aperture (not labeled) surrounded by the inner peripheral surface 30*a* is slightly larger than that of the knob 20. The annular flange 32 is formed at the top surface 30*c*. An inner diameter of the annular flange 32 is greater than a diameter of the knob 20. The cutout 34 is formed at the inner peripheral surface 30*a*, and is exposed at the bottom surface 30*d*. The pair of slots 36 is defined in the inner peripheral surface 30*a*, opposite to the cutout 34. The ring 30 further includes a number of threaded holes 38 evenly distributed on the bottom surface 30*d*, and corresponding to the through holes 16 of the base 10.

The snapping members 40 comprise a first snapping member 42, a second snapping member 44, and a third snapping member 46. Preferably, all of the first, second and third snapping members 42, 44, 46 are made of magnetic material, and are configured in a way such that they attract each other when the distances between them are short enough. The first snapping member 42 is housed in the cutout 34 of the ring 30, and the second and third snapping members 44, 46 are separately housed in the compartments 23*a* of the knob 20 correspondingly. Alternatively, the second and third snapping members 44, 46 can be made of iron, nickel, or alloy of iron and nickel instead of magnetic material. In such case, the second and third snapping members 44, 46 are attracted to the first snapping member 42 when the respective distances between the second and third snapping members 44, 46 and the first snapping member 42 are short enough. In another alternative embodiment, the first snapping member 42 can be made of iron, nickel, or alloy of iron and nickel instead of magnetic material. In such case, the second and third snapping members 44, 46 are attracted to the first snapping member 42 when the respective distances between the second and third snapping members 44, 46 and the first snapping member 42 are short enough.

The pair of contact pads 50 can function as electrodes. In such case, the contact pads 50 are correspondingly coupled to one or more circuits of a device in which the snapping switch 100 is installed, for selectively opening or closing the circuits. The pair of contact pads 50 are designated as a contact pad 50*a* and a contact pad 50*b*. The contact pad 50*a* is curved, and is deformably and tightly engaged in the slots 36 of the ring 30. The contact pad 50*b* is generally hook-shaped, and a main body of the contact pad 50*b* is nested in the gap 28 between the positioning plate 29 and the corresponding inner wall 27. A middle portion of the contact pad 50*a* is convex, and protrudes from the inner peripheral surface 30*a* of the ring 30. The middle portion of the contact pad 50*a* is capable of electrically contacting a hook portion of the contact pad 50*b* when the knob 20 is rotated to a certain position. In summary, the contact pad 50*a* is mounted at the inner peripheral surface 30*a* of the ring 30, and is always spaced apart from all three snapping members 40 by certain predetermined distances and/or by certain predetermined angles. The contact pad 50*b* is mounted on the bottom surface 20*b*, and is also always spaced apart from all three snapping members 40 by certain predetermined distances and/or by certain predetermined angles. When the knob 20 is rotated, the snapping members 40 distributed on the knob 20 and the ring 30 can attract each other to help ensure that switching on and switching off of a circuit that includes the contact pads 50 is reliably achieved.

Figure 4:
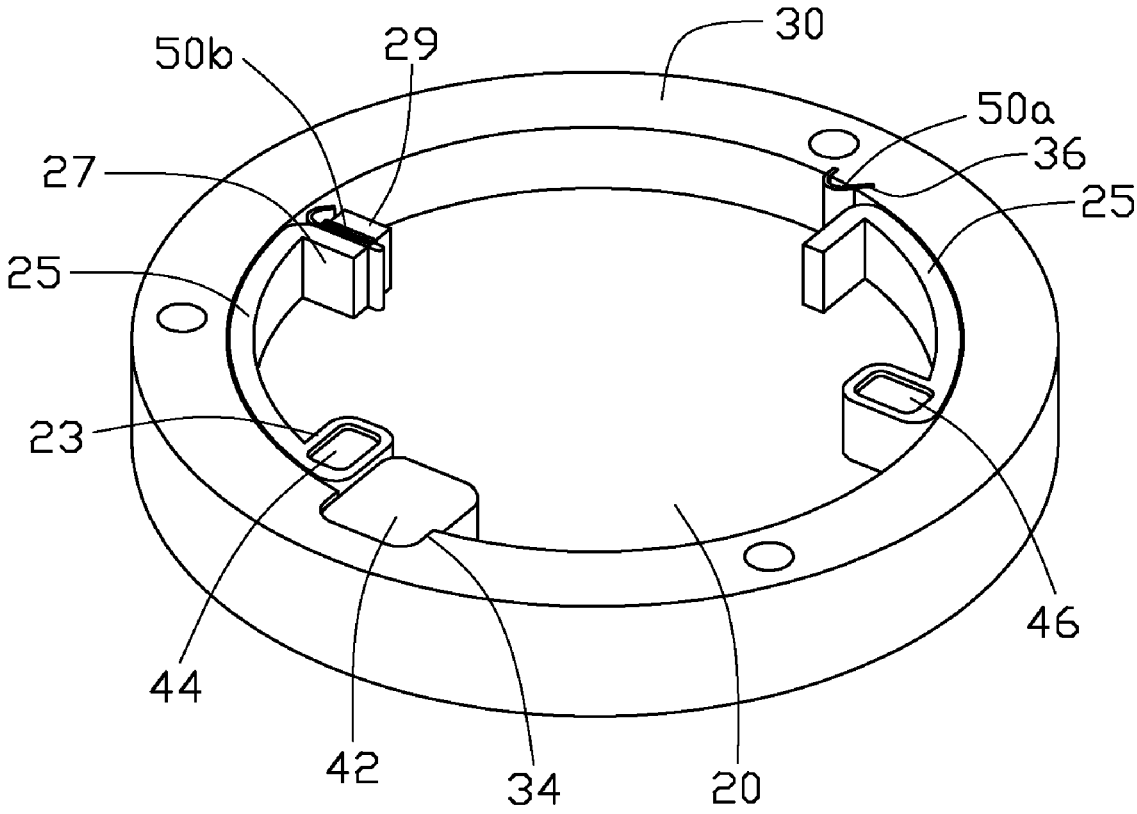
FIG. 4 is an assembled view of a knob and a ring of the snapping switch shown in FIG. 2, showing the knob in an "OFF" position.

Referring also to FIG. 4, in assembly, the knob 20 is inserted into the ring 30 until the top surface 20*a* abuts the flange 32 and the handle 21 protrudes out from above the ring 30. The first snapping member 42 of the ring 30 is positioned between the second and third snapping members 44, 46 of the knob 20. The ring 30 is mounted on the upper surface 12 of the base 10 by passing the bolts 70 through the through holes 16 and engaging the bolts 70 in the threaded holes 38 of the ring 30. The knob 20 is thus movably held in position by cooperation of the upper surface 12 and the flange 32.

Figure 5:
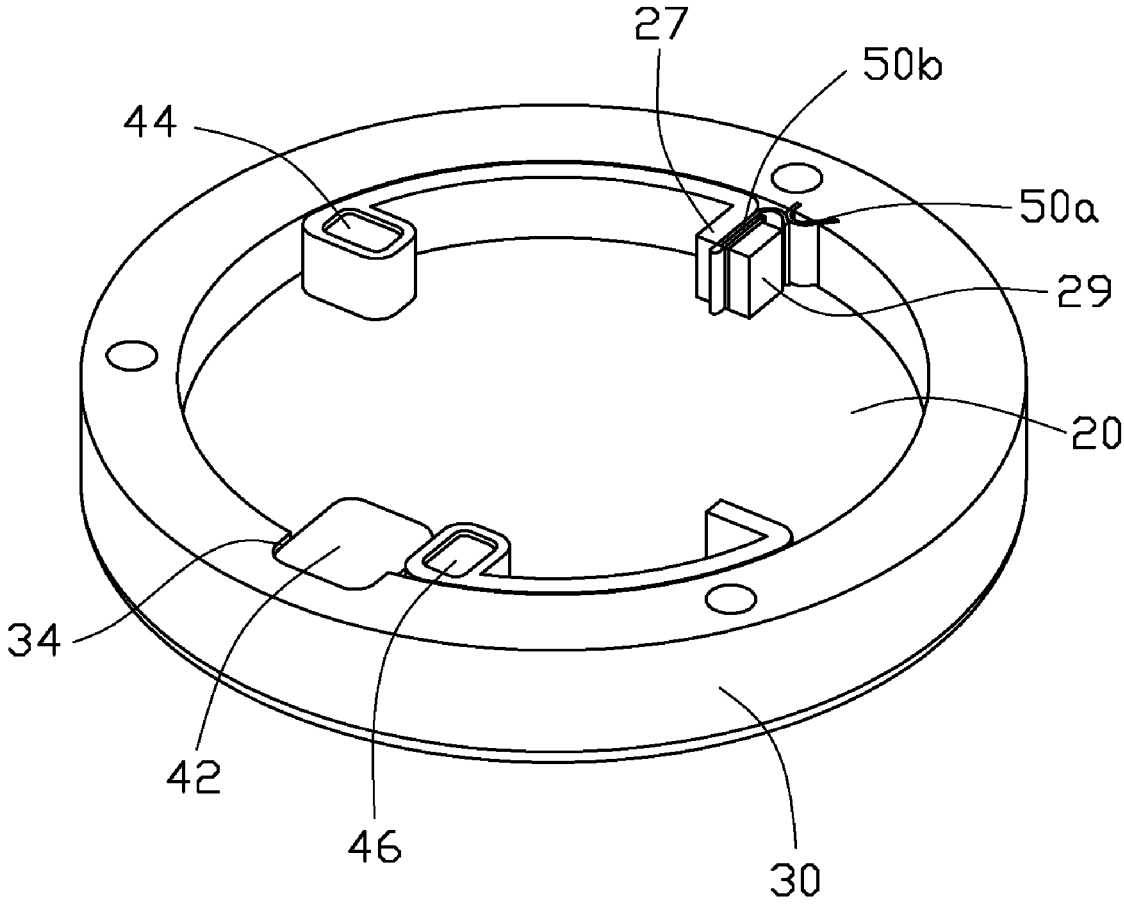
FIG. 5 is similar to FIG. 4, but showing the knob in an "ON" position after the knob has been rotated from the "OFF" position.

From the forgoing description, it will be appreciated that, in an exemplary embodiment, the knob 20 can be manually set to either an "OFF" position as shown in FIG. 4, or to an "ON" position as shown in FIG. 5. In the illustrated embodiment, when the knob 20 is in the "OFF" position, the first snapping member 42 attached to the ring 30 is strongly attracted to the second snapping member 44, thereby stably maintaining the snapping switch 100 in the desired position. When the knob 20 is in the "ON" position, the first snapping member 42 attached to the ring 30 is strongly attracted to the third snapping member 46, thereby stably maintaining the snapping switch 100 in the desired position.

In alternative embodiments, the first snapping member 42 can be provided on the knob 20, and the second and third snapping members 44, 46 can be provided on the ring 30 correspondingly. In other words, the position of the first snapping member 42 and the positions of the second and third snapping member 44, 46 can in essence be exchanged.

In summary, the three snapping members 40 of the snapping switch 100 can attract each other as described above, thereby enhancing the reliability of the snapping switch 100.

It is believed that the present embodiments and their advantages will be understood from the foregoing description, and it will be apparent that various changes may be made thereto without departing from the spirit and scope of the disclosure or sacrificing all of its material advantages, the examples hereinbefore described merely being preferred or exemplary embodiments of the disclosure.

What is claimed is:

1. A snapping switch comprising:

a base;

a ring mounted on the base;

a knob rotatably engaged with the base and the ring;

a first snapping member mounted on one of the ring and the knob;

a second snapping member and a third snapping member separately mounted on the other one of the ring and the knob, wherein the first snapping member is positioned between the second and third snapping members along a path of rotation defined by the knob; and a pair of contact pads respectively mounted on the ring and the knob, wherein when the knob is in a first position, the first snapping member and one of the second and third snapping members are magnetically attracted to each other and the pair of the contact pads are separate from each other; and when the knob is in a second position, the first snapping member and the other one of the second and third snapping members are magnetically attracted to each other and the pair of the contact pads contact each other.

2. The snapping switch in claim 1, wherein the base is generally disk-shaped and comprises an upper surface and a lower surface, and the ring is rotatably mounted on the upper surface of the base.

3. The snapping switch in claim 2, wherein the knob comprises a top surface and a bottom surface, two support walls extend downward from a periphery of the bottom surface of the knob, and the support walls are positioned generally symmetrically opposite each other across the bottom surface.

4. The snapping switch in claim 3, wherein the knob further comprises two holding members and two inner walls, one of the holding members and one of the inner walls adjoining opposite ends of one of the support walls, the other holding member and the other inner wall adjoining opposite ends of the other support wall, each of the holding members and the inner walls radially extending towards the center of the bottom surface of the knob.

5. The snapping switch in claim 4, wherein each of the holding members comprises a compartment defined therein for housing a corresponding one of the second and third snapping members.

6. The snapping switch in claim 5, wherein the knob further comprises a handle extending upward from a middle portion of the top surface of the knob.

7. The snapping switch in claim 6, wherein the knob further comprises a positioning plate extending downward from the bottom surface of the knob adjacent to one of the inner walls, a gap being defined between the positioning plate and the inner wall, the gap receiving one of the contact pads therein.

8. The snapping switch in claim 7, wherein the ring comprises an inner peripheral surface and an outer peripheral surface, a bottom surface between the inner and outer peripheral surfaces, a top surface interconnecting the inner and outer peripheral surfaces, and an annular flange at an inner periphery of the top surface.

9. The snapping switch in claim 8, wherein the ring further comprises a cutout defined in the inner peripheral surface and exposed at the bottom surface of the ring, and the first snapping member is received in the cutout of the ring.

10. The snapping switch in claim 9, wherein the ring further comprises a pair of slots defined in the inner peripheral surface generally opposite to the cutout, the other one of the contact pads is curved, and two ends of the other contact pad are engaged in the slots such that the other contact pad is deformably and tightly held in position.

11. The snapping switch in claim 10, wherein a middle portion of the other contact pad is convex and protrudes from the inner peripheral surface of the ring.

12. The snapping switch in claim 8, further comprising a plurality of threaded fasteners, wherein the ring comprises a plurality of threaded holes at the bottom surface; the base comprises a plurality of through holes spanning from the upper surface to the lower surface of the base, and the threaded fasteners extend through the through holes and are engaging in the threaded holes to fasten the ring on the base.

13. A snapping switch comprising:

a base;

a ring mounted on the base;

a knob rotatably engaged with the base and the ring;

a magnetized first snapping member mounted on one of the ring and the knob;

a second snapping member and a third snapping member made of material that is attracted to a magnetic field of the first snapping member, and separately mounted on the other one of the ring and the knob, wherein the magnetized first snapping member is positioned between the second and third snapping members along a path of rotation defined by the knob; and a pair of contact pads respectively mounted on the ring and the knob;

wherein the knob is rotatable between a first position in which one of the second and third snapping members is held in place by magnetic attraction between the magnetized first snapping member and said one of the second and third snapping members and the pair of the contact pads are separate from each other, and a second position in which the other of the second and third snapping members is held in place by magnetic attraction between the magnetized first snapping member and said other of the second and third snapping members and the pair of the contact pads are mechanically and electrically connected to each other.

14. The snapping switch in claim 13, wherein the base is generally disk-shaped and comprises an upper surface and a lower surface, and the ring is rotatably mounted on the upper surface of the base.

15. The snapping switch in claim 14, wherein the knob comprises a top surface and a bottom surface, two support walls extend downward from a periphery of the bottom surface of the knob, and the support walls are positioned generally symmetrically opposite each other across the bottom surface.

16. The snapping switch in claim 15, wherein the knob further comprises two holding members and two inner walls, one of the holding members and one of the inner walls adjoining opposite ends of one of the support walls, the other holding member and the other inner wall adjoining opposite ends of the other support wall, each of the holding members and the inner walls radially extending towards the center of the bottom surface of the knob.

17. The snapping switch in claim 16, wherein each of the holding members comprises a compartment defined therein for housing a corresponding one of the second and third snapping members.

18. The snapping switch in claim 17, wherein the knob further comprises a handle extending upward from a middle portion of the top surface of the knob.

* * * * *